US011072407B2

(12) United States Patent
Daniele

(10) Patent No.: US 11,072,407 B2
(45) Date of Patent: Jul. 27, 2021

(54) RIG FOR A NAUTICAL MEANS

(71) Applicant: Stramba S.R.L., Riccione (IT)

(72) Inventor: Mingucci Daniele, Riccione (IT)

(73) Assignee: STRAMBA S.R.L., Riccione (IT)

( * ) Notice: Subject to any disclaimer, the term of this patent is extended or adjusted under 35 U.S.C. 154(b) by 64 days.

(21) Appl. No.: 16/090,617

(22) PCT Filed: Mar. 28, 2017

(86) PCT No.: PCT/IB2017/051772
§ 371 (c)(1),
(2) Date: Oct. 2, 2018

(87) PCT Pub. No.: WO2017/178913
PCT Pub. Date: Oct. 19, 2017

(65) Prior Publication Data

US 2019/0112017 A1 Apr. 18, 2019

(30) Foreign Application Priority Data

Apr. 13, 2016 (IT) ..... 102016000038117

(51) Int. Cl.
*B63H 9/06* (2020.01)
*B63B 15/00* (2006.01)
(Continued)

(52) U.S. Cl.
CPC ..... *B63H 9/061* (2020.02); *B63B 15/00* (2013.01); *B63B 15/0083* (2013.01); *B63H 9/08* (2013.01);
(Continued)

(58) Field of Classification Search
CPC .... B63B 2015/0025; B63B 2015/0033; B63H 9/0628; B63H 9/0635; B63H 2009/086; B63H 9/0621
See application file for complete search history.

(56) References Cited

U.S. PATENT DOCUMENTS

2002/0178985 A1 12/2002 Roberts
2011/0303140 A1* 12/2011 Cordier ..... B63H 9/0628 114/102.12
2019/0193825 A1* 6/2019 Serre ..... B63H 9/061

FOREIGN PATENT DOCUMENTS

DE 196 15 556 A1 10/1997
ES 8 305 266 A1 4/1983
(Continued)

OTHER PUBLICATIONS

International Search Report and Written Opinion for PCT Application No. PCT/IB2017/051772 dated Jun. 28, 2017.

*Primary Examiner* — Andrew Polay
(74) *Attorney, Agent, or Firm* — Schott, P.C.

(57) ABSTRACT

The present invention relates to a rig (2) for a nautical means comprising: —a reference plane intended to coincide with a symmetry plane extending in longitudinal and vertical direction of the hull of the nautical means; —at least one wing; —at least one rigid support capable of supporting said wing and transmitting a propulsive thrust to the hull of the nautical means given by the aerodynamic lift generated by the wing when it takes wind; —the wing comprising a first and a second main face opposite to each other, —the rigid support being capable of supporting the wing at least in a first operating configuration in which at least a main portion of the first or second face is facing a first side of the reference plane and in a second operating configuration in which said main portion is facing the opposite side of the reference plane; —the rigid support comprising a wing sliding path for switching from the first to the second operating position and vice versa.

18 Claims, 5 Drawing Sheets

(51) Int. Cl.
*B63H 9/061* (2020.01)
*B63H 9/08* (2006.01)

(52) U.S. Cl.
CPC .... *B63B 2015/0025* (2013.01); *B63H 9/0621* (2020.02); *B63H 9/0628* (2020.02); *B63H 9/0635* (2020.02); *B63H 2009/086* (2013.01)

(56) References Cited

FOREIGN PATENT DOCUMENTS

| | | | |
|---|---|---|---|
| FR | 2 825 341 | A1 | 12/2002 |
| FR | 3 001 437 | A1 | 8/2014 |
| IT | 1404515 | B1 | 11/2013 |

* cited by examiner

RIG FOR A NAUTICAL MEANS

FIELD OF THE INVENTION

In the most general aspect thereof, the present invention relates to the nautical field and in particular it relates to a rig for a nautical means.

More specifically, the invention relates to a rig of the above type comprising a mast, at least one element for generating an aerodynamic thrust and riggings.

The invention also relates to a nautical means comprising such a rig.

BACKGROUND OF THE INVENTION

In the nautical field, particularly in the field of nautical means, different kinds of rigs have developed over the centuries, all essentially comprising at least one mast, at least one sail associated to the mast and the so-called riggings, namely that system adapted to govern the sail and comprising ropes, cords and lines as well as optionally a boom and similar elements for controlling the sail.

Among the different types of rigs, the so-called Bermuda or Marconi rig has established itself compared to the Portuguese rig and to the Latin one, in particular because it is more advantageous under different points of view, including greater speed and more performing upwind angles.

An example of a latin rig is in the patent FR285341.

Briefly, a Bermuda rig is essentially formed by a mast, a triangular sail aft the mast, a sail maneuvering boom as well as other riggings of the aforesaid type.

More recently, on the basis of the Bermuda rig, the so-called "wing sail" technology has been developed, in which the classic sails, or a part of them, have been replaced with wings, that is to say, with rigid elements provided with a significant thickness that is influential on the aerodynamic thrust values.

In particular, rigs have become widespread which comprise symmetrical wings or asymmetrical wings.

In principle, the symmetrical wings allow, with regard to the pace, the same rigging allowed to a vessel equipped with a conventional sail, but they do not allow reefing nor furling.

The rigid wing structure, in fact, does not allow reducing the surface thereof, precisely reefing, nor does it allow the wing to be furled like a sail, precisely the furling.

For any type of intervention on the wing it is therefore necessary to use an external support, so in practice it is necessary to dismast the vessel.

Solutions with symmetrical wings are therefore used for competitions or otherwise short range sailing.

Asymmetrical wings, on the other hand, have made it possible to reach very high values of aerodynamic thrust, so much so that specially designed asymmetrical wings are used in boats dedicated to particular competitions also for the achievement of speed records.

However, although they are very high performance with regard to speed, the vessels equipped with a rig comprising an asymmetric wing do not allow the typical rigging of sailing and, therefore, their use remains limited and confined to certain competitions, as indicated above.

Also in this case, it is not possible to reef nor furl.

A sailing rig is also known, described in Italian Patent No. 1404515, in which a sail is associated with a mast having a shape of an inverted U, which suffers from a lack of rigidity and in any case a poor leech tension.

SUMMARY OF THE INVENTION

The technical problem underlying the present invention was to provide a rig for a nautical means having such structural and functional features as to overcome one or more of the drawbacks mentioned above with reference to the prior art.

According to the invention, the above problem is solved by a rig for a nautical means comprising:

- a reference plane intended to coincide with a symmetry plane extending in longitudinal and vertical direction of the hull of the nautical means;
- at least one wing;
- at least one rigid support capable of supporting said wing and transmitting a propulsive thrust to the hull of the nautical means given by the aerodynamic thrust generated by the wing when it takes wind;
- the wing comprising a first and a second main face opposite to each other and able to cooperate to generate at least one aerodynamic thrust, preferably a maximum thrust in at least one predetermined direction by interaction with the wind coming from at least one predetermined optimum direction, the predetermined direction being preferably incident with said faces;
- the rigid support being capable of supporting the wing at least in a first operating configuration in which at least a main portion of the the first or second face is facing a first side of the reference plane and in a second operating configuration in which said main portion is facing the opposite side of the reference plane;

the rigid support comprising a wing sliding path for switching from the first to the second operating position and vice versa.

Preferably, the wing position in the at least one first operating configuration is symmetrical to the position in the at least one second operating configuration with respect to the reference plane.

It is noted that said symmetrical orientation does not exclude asymmetry of the rig, although in the preferred embodiments the rig is symmetrical with respect to said plane.

The mast preferably comprises a coupling portion to a hull of the nautical means, where this contemplates both a fixed coupling and a connection that can be coupled and uncoupled.

According to a preferred feature of the invention, each support supports only one wing, where this does not exclude that it is replaceable, in which case the support supports a single wing at a time. The support is therefore capable of supporting the wing (or a main portion thereof) alternately from one side or the other of the reference plane switching from one operating configuration to the other to take wind always on the same face of the wing, which then acts as a tack in both configurations.

In general, the rig preferably comprises means for modifying the aerodynamic thrust, intended to be transmitted to the hull of the nautical means through the rigid support to generate the propulsive thrust, the modification means comprise at least actuating means for the wing displacement between the two operating configurations, optionally they further comprise means for adjusting the thrust. It therefore noted that "modifying" the thrust comprises, for example, changing its direction when switching from one operating configuration to the other, or adjusting its size.

According to some preferred embodiments of the invention, the rigid support comprises at least one mast with at least two opposed portions (preferably symmetrical) with respect to the reference plane and at least one connecting portion of the two opposed portions, where said two opposed portions and the connecting portion define said sliding path.

In this case, preferably, said two opposed portions each comprise at least one essentially linear stretch, and wherein preferably said connecting portion comprises at least one curved stretch.

Among the preferred embodiments we may mention the mast in the shape of "U" or "O" that are symmetrical with respect to said reference plane.

According to a general preferred feature of the invention, said wing has an asymmetrical wing profile.

In this case, preferably said wing profile comprises a proximal portion to said support and a distal portion from said support, wherein said proximal portion has a width greater than said distal portion, said wing profile being preferably concave on one of the main faces and preferably convex on the other.

According to a general preferred feature of the invention, the wing is coupled to the support in oriented manner in order to generate said maximum aerodynamic thrust directed towards the reference plane both in the first and in the second operating configuration, or is oriented in order to generate an aerodynamic thrust directed away from the reference plane both in the first and in the second operating configuration. This means that the orientation allows having thrust directions incident with the reference plane, where no angle of incidence is excluded. It is not excluded that the angle of incidence may be adjusted with adjusting means, nor it is excluded that the adjustment makes the thrust direction parallel to the reference plane.

In general, it is preferable that the wing can be disassembled and reassembled to switch from one of said maximum aerodynamic thrust directions to the other and vice versa.

According to some preferred embodiments, said wing comprises a plurality of modules, preferably divided along planes perpendicular to said reference plane, and association means for the association, preferably removable, of each module with an adjacent module, each module being free in rotation, at least by a predetermined angle, with respect to an adjacent module.

In this case, preferably, said association means are selected from the group comprising hinges, snap association means, hooks, adhesives association means, elastic association means, tear-off association means, zippers.

According to some preferred embodiments, said driving means comprise a plurality of connecting elements for the removable connection between said wing and said mast, more preferably comprising at least one connecting element for each of said modules, each of said modules being preferably selectively associable to, and removable from, said mast, said connecting elements being slidable along the extension direction of said mast.

In this case, it is preferable that at least said connecting elements are free in rotation on a plane essentially perpendicular to said mast at least by a predetermined angle, preferably an angle of about 180°, said wing being able to rotate with respect to said mast by a stretch at least equal to said predetermined angle.

Preferably, said connecting elements are removable from said wing and/or from said mast, said connecting elements having a T-shape and being rotatable with respect to said wing and/or with respect to said mast for the attachment of said connecting elements, and a release of the same, to/from said mast.

According to a general preferred feature, the thrust modification means are selected from the group comprising manually operated means including ropes, cords and lines, mechanical actuation means, electric actuation means, pneumatic actuation means, means comprising a system of counterweights or a combination of such means.

According to the invention, the above problem is also solved by a nautical means comprising a rig of the above type, in which nautical means denotes any vessel, any boat or any ship, even multihull.

The above expression "wing profile" refers to a section of said wing, or of said modules, made according to a plane perpendicular to the wing or to the modules, and parallel to the centerline of the wing itself or the modules themselves.

In practice, according to the invention, a rig for a nautical means is provided, which comprises a wing instead of a traditional sail, thus an element for the generation of aerodynamic thrust also provided with a thickness that is influential on the same aerodynamic thrust.

Still according to the invention, the above wing may be rigid, semi-rigid, soft or inflatable, solid or hollow, and therefore also the above modules can be made of rigid, semi-rigid, soft or inflatable material, solid or hollow.

The mast may have an inverted U shape having one free end and one end associated with the nautical means via at least one foot, or the mast may comprise a U-shape (straight), or it may comprise a closed shape, such as an O, with a single foot from which one of said two opposed portions extends, or with two feet from which the above two opposed portions extend (direct association), respectively, or with a single foot from which said at least one connecting portion extends (indirect association), if the above closed shape is comprised, said mast also comprises a second connecting portion, preferably having at least one curved stretch, extending between said two opposed portions. Other shapes are not excluded.

Therefore, according to the foregoing, the rig according to the present invention allows the movement of said wing from one end to the other of the reference plane, more preferably from one side to the other of the nautical means, allowing the wing itself to take wind always on the same side, preferably the concave side of said wing, with both starboard tack and with port tack.

Still according to the foregoing, the modularity of the above wing allows assembling such a number of modules as to have a desired wing surface, as well as removing one or more modules of an assembled wing to modify the wing surface thereof to a desired value, also with wing already associated with the mast (possibility of reefing), and furling during navigation is allowed.

BRIEF DESCRIPTION OF THE FIGURES

Further features and advantages of the invention will appear more clearly from the following detailed description of a preferred but non exclusive embodiment, shown by way of a non limiting example with the aid of the accompanying drawings, in which:

FIGS. 1*bis* and 1*ter* schematically show a sectional view according to plane P2 in FIG. 1 of the assembly of the wing on the mast according to two different orientations;

DETAILED DESCRIPTION OF THE INVENTION

Figure 1:
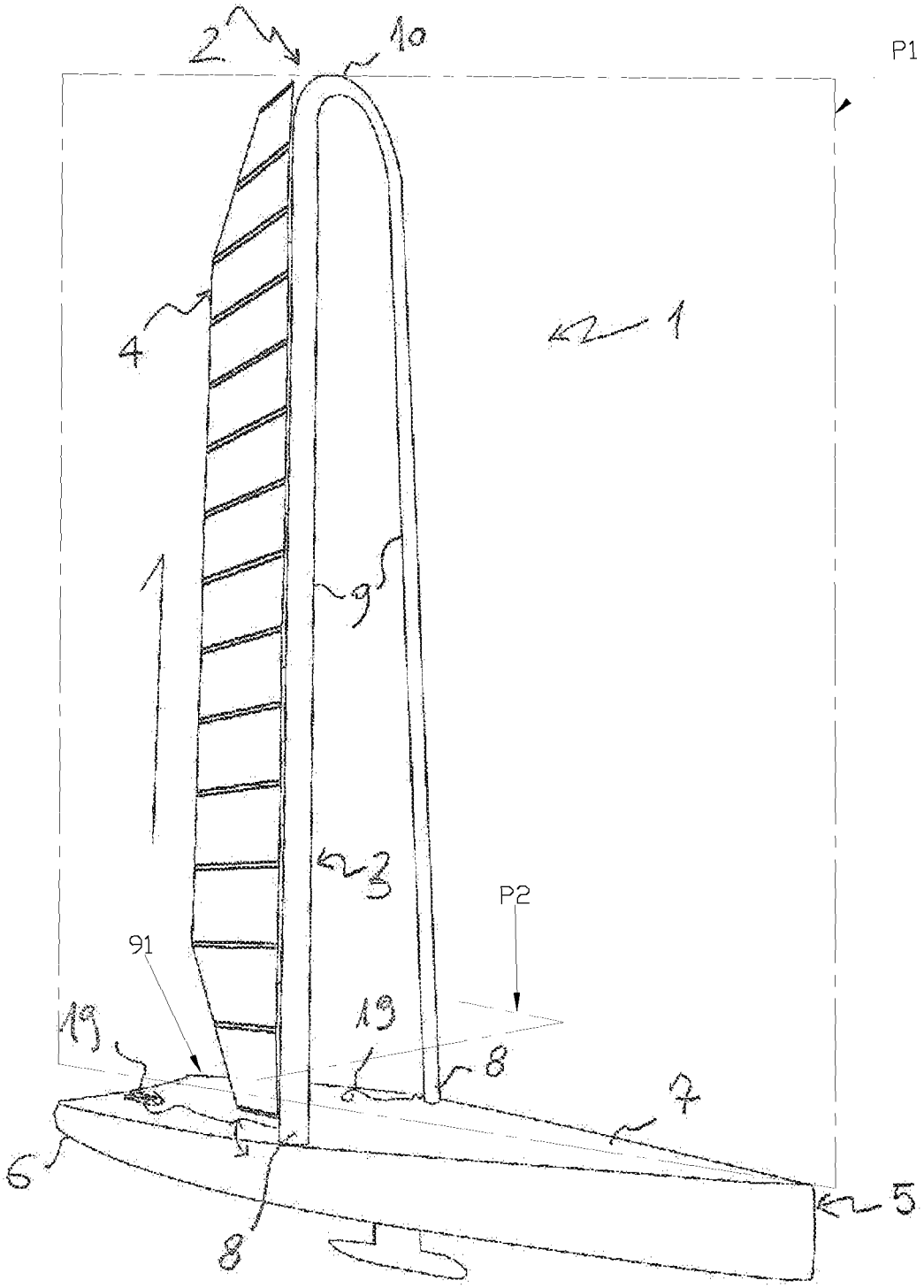
FIG. 1 schematically shows a nautical means equipped with a rig comprising a mast, a movable and modular wing comprising a plurality of modules in a first position, and riggings, according to the present invention.
Figure 2:
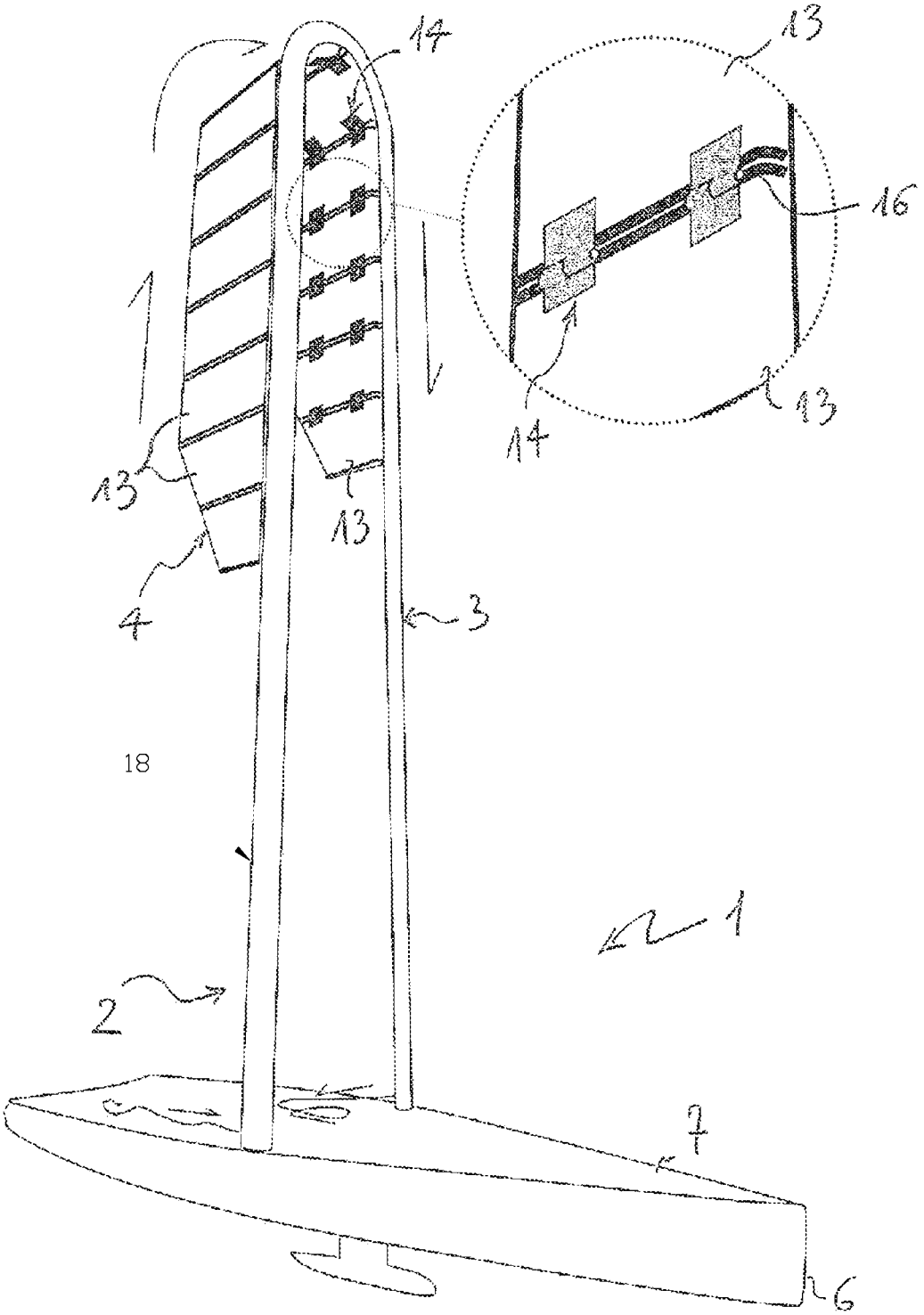
FIG. 2 shows the nautical means in FIG. 1 with the above wing in a second position, with a relative enlarged detail.
Figure 3:
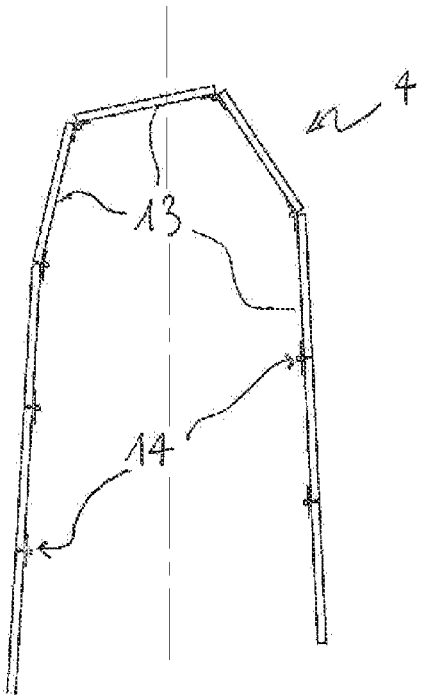
FIG. 3 shows a longitudinal sectional view along a plane parallel to the above mast of the wing of the nautical means in FIG. 2.
Figure 4:
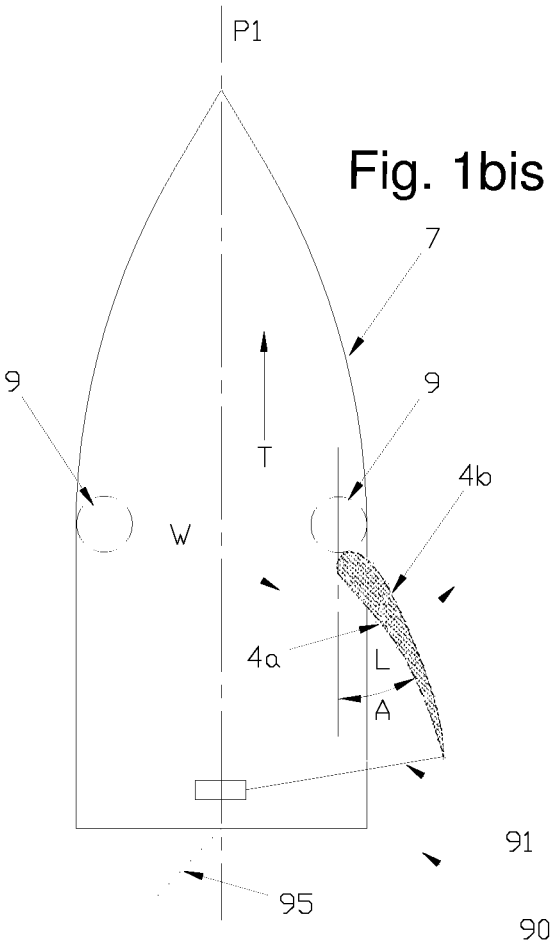
FIG. 4 shows a cross-sectional view along a plane perpendicular to the above mast of a module of the wing and of the mast of the nautical means in FIG. 1.
Figure 4:
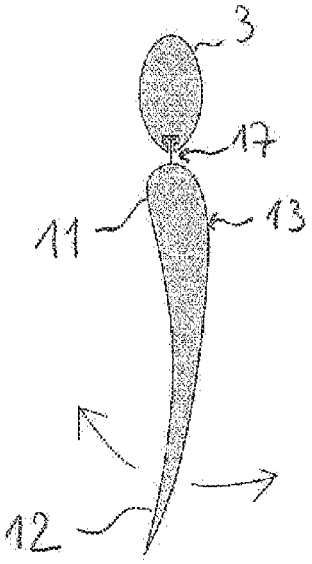

With reference to the above figures, reference numeral 1 generally indicates a nautical means equipped with a rig 2 comprising a mast 3, a wing 4 and means for modifying the thrust, according to the present invention.

The nautical means according to the present invention may be of any type, such as a vessel, a boat or a ship, and according to the examples in the figures it is represented with a main body 5 essentially formed by a hull 6 and a deck 7.

Rig 1 comprises a symmetry plane P1, coincident with the symmetry plane extending in the longitudinal and vertical direction of the nautical means, i.e. a vertical plane extending from bow to stern. However, embodiments in which the symmetry plane of the hull is only a reference plane for an asymmetrical rig with respect thereto are not excluded.

In detail, mast 3 comprises two feet 8 for the association, preferably removable, with the main body 5 of the nautical means 1, from which two portions 9 extend which are opposite with respect to plane P1 and joined together by a connecting portion 10.

According to the examples in the figures, the two opposed portions 9 are essentially linear while the connecting portion 10 is essentially curved and, therefore, mast 3 as a whole has a shape of an inverted U, closed on the main body 5 of the nautical means 1.

Figure 5:
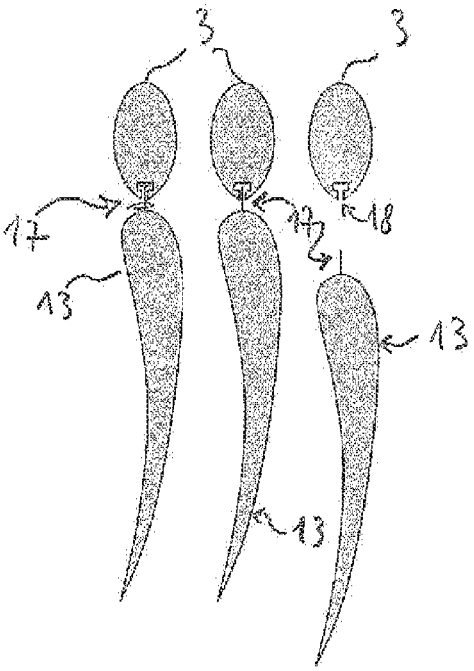
FIG. 5 shows the section of FIG. 4 in three different moments during an operation of removing a module from the mast.
Figure 6:
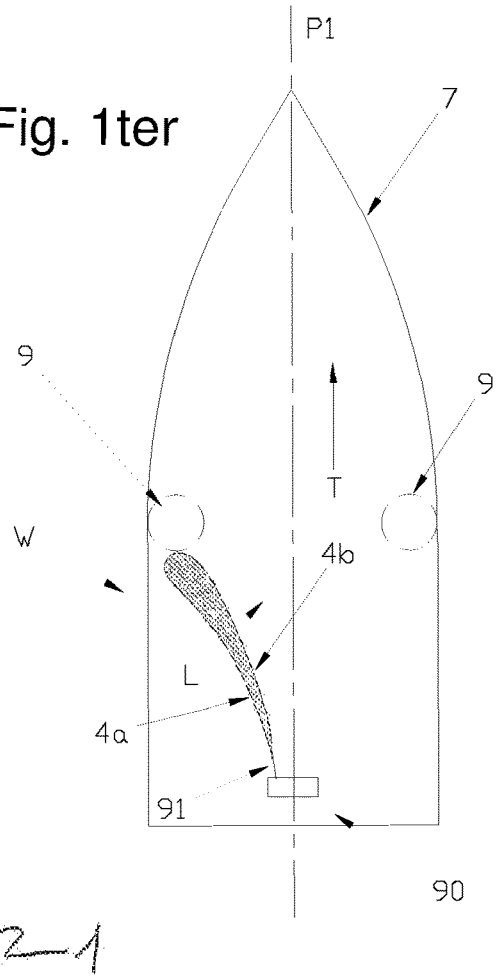
FIG. 6 shows the nautical means in FIG. 1 during the removal of a module of the wing from the mast.
Figure 6:
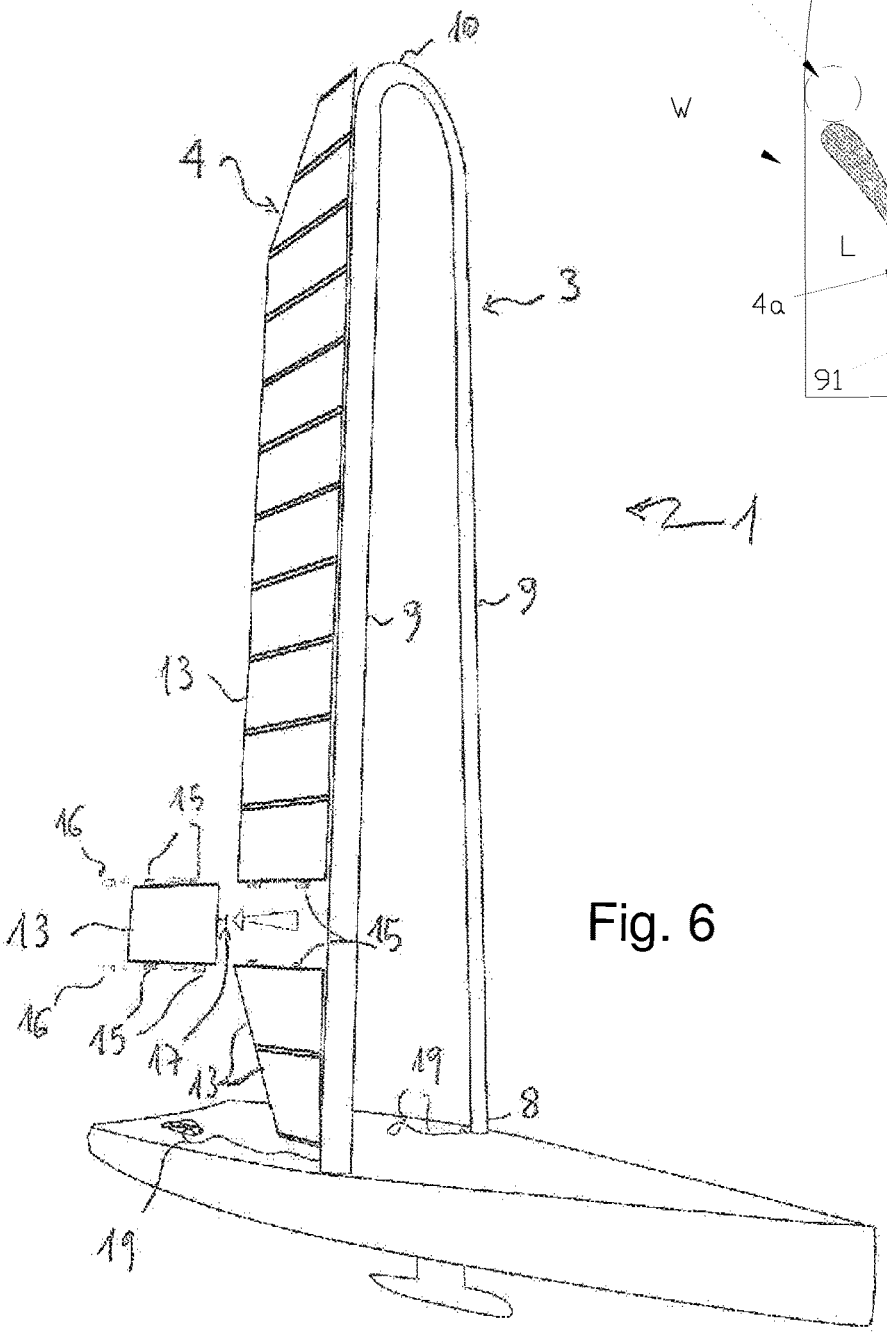
Figure 7:
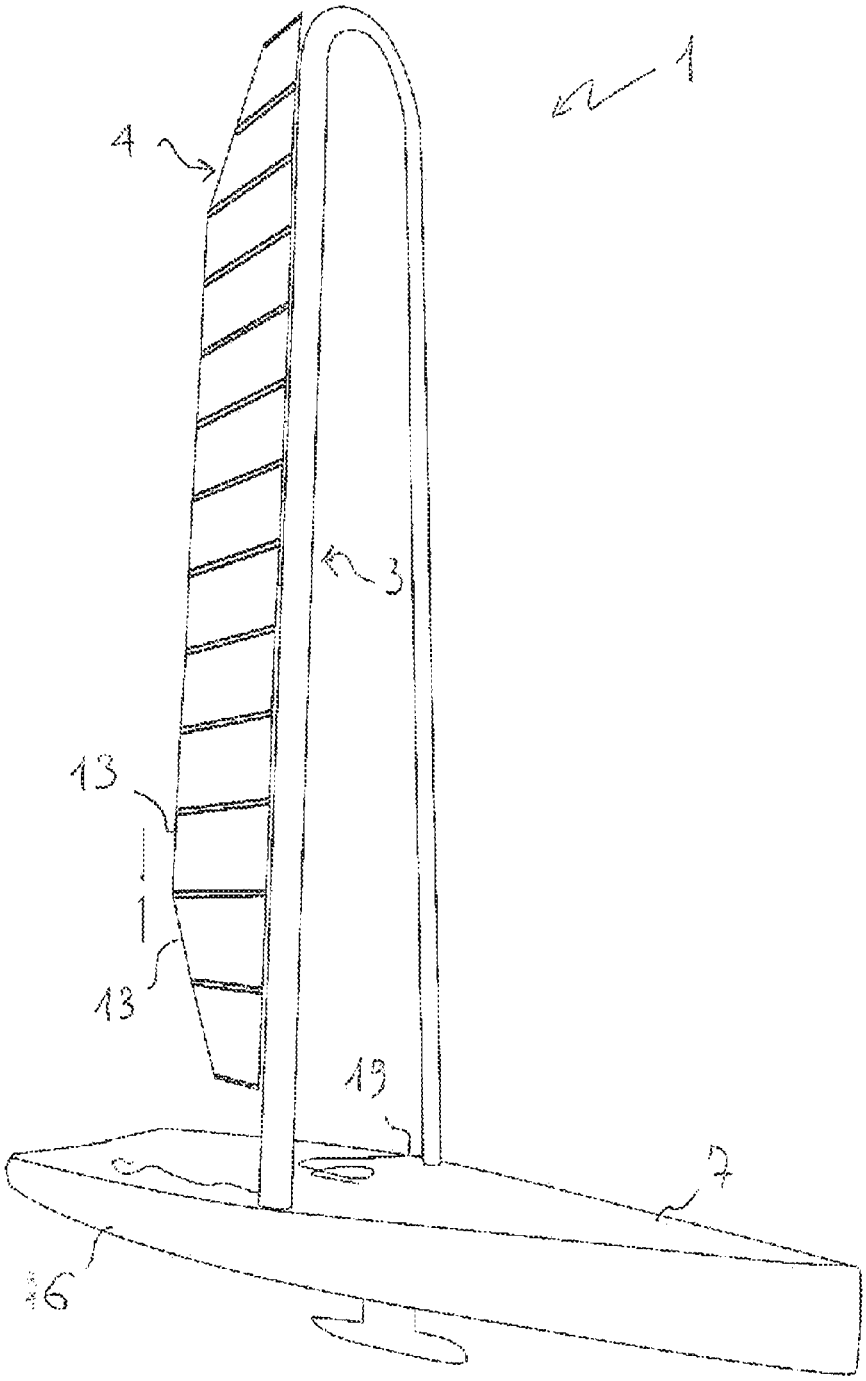
FIG. 7 shows the nautical means in FIG. 6 after the removal of a module.

The opposed portions 9 and the connecting portion 10 define a sliding path 18 (best seen in FIG. 5) along the entire extension of the mast that allows for the passage by sliding of the wing from one of the opposed portions to the other and vice versa, thus causing the overturning of its orientation with respect to plane P1. The positioning of the wing, or of a main portion thereof, on one or the other of the opposed portions 9 of mast 3 are said first and second operating configurations.

According to the invention, wing 4, which is removably associated with mast 3, is movable between the two opposed portions 9 of mast 3 itself by virtue of the aforesaid modification means which include actuating means (17) for the displacement of the wing at least along mast 3 and active control means (19) on the actuating means, as will become apparent hereinafter.

According to the invention, wing 4 has an asymmetrical wing profile, according to the examples of the figures a concave-convex profile, possibly laminar concave-convex, not being however excluded the possibility to contemplate different wing profiles, such as a plano-convex, biconvex asymmetrical, or even a symmetrical wing profile.

According to the examples in the figures, the wing profile of wing 4, and thus the wing itself, comprises a proximal portion 11 to mast 3 and a distal portion 12 from mast 3, in which the proximal portion 11 has a greater width than the distal portion 12.

Still with reference to wing 4, according to the invention, it should be noted that it comprises a plurality of modules 13 advantageously divided along planes perpendicular to mast 3, and association means 14 for the association of each module 13 with an adjacent module.

The association means 14 allow a removable association of a given module 13 to each module adjacent thereto and may consist, for example, of hinges, snap association means, hooks, adhesive association means, elastic association means, tearing association means or zippers, in the example in the figures the association means 14 being represented by hinges.

In particular, according to the examples in the figures, the association means 14 in the form of hinges include, for two adjacent modules 13, a pair of passages 15 for each module, and then pairs of opposed passages in the adjacent modules, and a pair of pins 16 which removably engage passages 15, not being however excluded the possibility of providing a different number of passages and pins, even a single pin that removably engages all opposed passages in adjacent modules.

According to the invention, it should be noted that each module 13 is free in rotation, at least by a predetermined angle, with respect to an adjacent module, wing 3 thus being able to bend to slide on mast 3 and switch from one to the other of the two opposed portions 9, by virtue of the driving means.

As regards the driving means, indicated with reference numeral 17, it should be noted that they advantageously comprise a plurality of connecting elements for the removable connection of wing 4 to mast 3, and preferably comprise at least one connecting element for each module 13 of wing 4, thus being able to selectively remove a desired module 13 from wing 4 and then from mast 3, or associate a module 13 to wing 4, and then to mast 3, even when wing 4 is associated to mast 3, and thus while sailing (reefing), not being however excluded the possibility of providing a number of connecting elements less than the number of modules of the wing, the modules being however mutually associated.

In detail, the moving means 17, and thus the connecting elements, are slidable along the sliding path 18 defined by mast 3 along its development direction, for example thereon or therein, as shown in the examples in the figures, the sliding path having in the latter case a profile provided with a groove having a widened bottom, the groove for example having a T section.

In addition, the moving means 17, and thus the connecting elements, are free in rotation with respect to mast 3, in particular on an plane essentially orthogonal to mast 3, at least by a predetermined angle A (FIGS. 1*bis* and 1*ter*), preferably an angle of about 180°, i.e. an angle of between about −90° and about +90° with respect to an alignment position in which wing 4 is essentially parallel to plane P1.

Angle A affects the thrust, so it can be adjusted as desired by the user by means for adjusting the aerodynamic drift 90, such as ropes 91 that secure the wing relative to the hull.

In this way, wing 4 can rotate with respect to mast 3 by a distance equal to the above angle, the connecting elements being movable with respect to mast 3 and also fixed to wing 4 itself.

In this regard, it should be noted that for the above removable association of wing 4, thus of modules 13, to mast 3, the driving means 17, and thus the connecting elements, are removable from the wing and/or from the mast.

According to the examples in the figures, the driving means 17, and thus the connecting elements, are shown removable from mast 3, and in particular they are shown rotatable with respect to the wing and the mast and with a T-shape, for hooking or releasing the same to/from mast 3.

With regard to the active control means on the driving means 17, it should be noted that they may be manual actuation means, such as cables, ropes and lines, or mechanical actuation means, electrical actuation means, pneumatic actuation means as well as means comprising a system of counterweights or a combination of such means.

The examples in the figures show control means 19 in the form of ropes.

The examples in the figures also show, by means of arrows, the movements that the wing, the modules of the wing itself, the wing and module driving means and the control means can perform.

With reference to FIG. 1*bis*, it schematically shows that when the wind impinges the wing in the direction of arrow W, the latter generates an aerodynamic thrust, that is, a thrust in the direction of arrow L. This thrust is transmitted to the hull by the mast, thus generating the propulsive thrust T, also maintained in the desired direction by means of rudder 95.

In this example, wing 4 is associated with mast 3 with such an orientation that thrust L is directed away from plane P, according to an angle with respect thereto that depends on the adjustment angle A. In the case of wind aft, one might get to have a thrust L parallel to P1.

Wing 4 has a main face 4*a* used as tack facing plane P1 both in the first and in the second operating configuration, and another main face 4*b* opposite to 4*a*.

In the example in FIG. 1*ter*, the orientation of the wing (in particular of faces 4*a* and 4*b* of the asymmetric concave/convex example shown) is opposite compared to that in FIG. 1*bis* in the two operating configurations. This causes thrust L to be in this case directed towards plane P1 in the same wind conditions.

It is possible to contemplate rigs in which wing 4 can be disassembled from the mast and reassembled with reversed faces 4*a* and 4*b* to switch from the orientation in FIG. 1*bis* to that in FIG. 1*ter* and vice versa, as well as wigs in which the wing can be coupled to mast 3 with only one of said two orientations.

The advantages of the present invention already appeared in the above description can be summarized by observing that a rig for a nautical means and a nautical means comprising the same rig are provided, which allow higher overall performance compared to those achieved by nautical means equipped with rigs according to the prior art.

The rig and the nautical means according to the present invention allow, in fact, to take the wind always on the same side of the wing, with a significant increased aerodynamic thrust (predictably from 20% to 50%), thereby increasing the performance both as regards speed and in terms of upwind that can follow routes of various degrees closer to the wind direction.

Moreover, with particular reference to the embodiment of the present rig as an inverted U, the more distant is the wing from the reference plane P1 in the operating configurations (i.e. the wider the U in the illustrated example), up to the preferred case of having the mast joined to the hull at the edges as in the illustrated examples, the greater is the floor area of the nautical means compared to single-mast solutions, and the location of the sailors is no longer bound or limited by the arrangement of the mast, the boom and/or some riggings with respect to the main body of the nautical means.

Moreover, due to the modularity of the wing, the operations of rigging and derigging of the nautical means are considerably facilitated compared to current wings.

The wing modularity also allows varying the surface of the wing itself, and thus of the element which generates the aerodynamic thrust as desired, even during navigation with rigged nautical means and wing mounted and associated with the mast.

Several changes and modifications may be made by the man skilled in the art to the present invention, in the illustrated and described embodiments, in order to meet contingent and specific requirements, all falling within the scope of protection of the invention as defined by the following claims.

The invention claimed is:

1. Rig (2) for a nautical means, comprising:

a reference plane (P1) that coincides with a symmetry plane extending in longitudinal and vertical direction of a hull (6) of the nautical means;

at least one wing sail (4), that differs from a traditional sail in that has a wing profile for the generation of aerodynamic thrust (L) also provided with a thickness that is influential on the same aerodynamic thrust, wherein the wing can be rigid, semi-rigid, soft or inflatable, in the case of a rigid wing has articulated modules;

at least one rigid support (3) capable of supporting said wing and transmitting a propulsive thrust to the hull of the nautical means given by the aerodynamic thrust generated by the wing when it takes wind;

wherein the wing comprises a first and a second main face (4*a*, 4*b*) opposite to each other;

the rigid support (3) being capable of supporting the wing at least in a first operating configuration in which at least a main portion of the first or second face is facing a first side of the reference plane (P1) and in a second operating configuration in which said main portion is facing the opposite side of the reference plane;

the rigid support comprising a wing sliding path (18) for switching from the first to the second operating position and vice versa;

wherein the support is capable of supporting the wing or a main portion thereof alternately from one side or the other of the reference plane switching from one operating configuration to the other so as to allow the wing to take wind always on the same side, which then acts as a tack in both configurations;

wherein the rigid support comprises at least one mast with at least two opposed portions with respect to the reference plane and at least one connecting portion of the two opposed portions, where said two opposed portions and the connecting portion define said sliding path to generate the overturning of the wing with respect to said reference plane, said path causing the overturning of the orientation of the wing with respect to said reference plane, and said wing sail having an asymmetrical wing profile; and wherein the articulating modules are hinged to each other along adjacent edges thereof so that the articulating modules move with respect to each other during the overturning of the wing sail along the sliding path.

2. Rig according to claim 1, characterized in that each support supports a single wing only.

3. Rig according to claim 1, further comprising a means for modifying the aerodynamic thrust, to be transmitted to the hull of the nautical means through the rigid support to generate the propulsive thrust, the modification means comprise at least actuating means (17) for the wing (4) displacement between the two operating configurations, further comprising means for adjusting the thrust.

4. Rig according to claim 1, wherein said two opposed portions (9) each comprise at least one linear stretch, and wherein said connecting portion (10) comprises at least one curved stretch.

5. Rig according to claim 1, characterized in that the mast is in the shape of "U" or "O" that are symmetrical with respect to said reference plane.

6. Rig according to claim 1, wherein said wing profile comprises a proximal portion (11) to said support (3) and a distal portion (12) from said support (3), wherein said proximal portion (11) has a width greater than said distal portion (12), said wing profile being concave on one of the main faces and preferably convex on the other.

7. Rig according to claim 1, characterized in that the wing is coupled to the support and oriented in order to generate at least one maximum aerodynamic thrust directed towards the reference plane both in the first and in the second operating configuration, or is oriented in order to generate an aerodynamic thrust directed away from the reference plane both in the first and in the second operating configuration.

8. Rig according to claim 7, characterized in that the wing can be attached and detached from the support to switch from one of said maximum aerodynamic thrust directions to the other and vice versa.

9. Rig according to claim 1, wherein said wing (4) comprises a plurality of modules (13) divided along planes perpendicular to said reference plane, and wherein the association means (14) for the association, are configured to allow each module (13) to be removeable with respect to an adjacent module, each module (13) being free in rotation, at least by a predetermined angle, with respect to an adjacent module.

10. Rig according to claim 9, wherein said two opposed portions (9) each comprise at least one essentially linear stretch, wherein said driving means (17) comprise a plurality of connecting elements for the removable connection between said wing (4) and said mast (3) and at least one connecting element for each of said modules (13).

11. Rig according to claim 10, wherein said connecting elements are free in rotation on a plane essentially perpendicular to said mast (3) at least by a predetermined angle of 180°, said wing (4) being able to rotate with respect to said mast (3) by a stretch at least equal to said predetermined angle.

12. Rig according to claim 10, wherein said connecting elements are free in rotation on a plane essentially perpendicular to said mast (3) at least by a predetermined angle.

13. Rig according to claim 10, wherein said connecting elements are removable from said wing (3) and/or from said mast (4), said connecting elements having a T-shape and being rotatable with respect to said wing (3) and/or with respect to said mast (4) for the attachment of said connecting elements, and a release of the same, to/from said mast.

14. Rig according to claim 10, wherein each of said modules (13) is selectively associable to, and removable from, said mast (3), said connecting elements being slidable along the extension direction of said mast (3).

15. Rig according to claim 1, further comprising a means for modifying the aerodynamic thrust, to be transmitted to the hull of the nautical means through the rigid support to generate the propulsive thrust, the modification means comprise at least actuating means (17) for the wing (4) displacement between the two operating configurations.

16. Rig according to claim 1, wherein said two opposed portions (9) each comprise at least one linear stretch.

17. Rig according to claim 1, wherein said wing (4) comprises a plurality of modules (13), divided along planes perpendicular to said reference plane, wherein each module (13) of the plurality of modules is free to rotate, at least by a predetermined angle, with respect to an adjacent module.

18. Rig according to claim 17, wherein the association is removable.

* * * * *